US012509969B2

(12) United States Patent
Ezzell et al.

(10) Patent No.: US 12,509,969 B2
(45) Date of Patent: Dec. 30, 2025

(54) SAFE PERFORATION GUN SYSTEM

(71) Applicant: Axis Wireline Technologies, LLC, Canonsburg, PA (US)

(72) Inventors: Sherrell Ezzell, Victoria, TX (US); David Council Benker, Cedar Park, TX (US)

(73) Assignee: Axis Wireline Technologies, LLC, Canonsburg, PA (US)

( * ) Notice: Subject to any disclaimer, the term of this patent is extended or adjusted under 35 U.S.C. 154(b) by 0 days.

(21) Appl. No.: 18/409,206

(22) Filed: Jan. 10, 2024

(65) Prior Publication Data

US 2024/0229619 A1 Jul. 11, 2024

Related U.S. Application Data

(60) Provisional application No. 63/438,285, filed on Jan. 11, 2023.

(51) Int. Cl.
*E21B 43/1185* (2006.01)
*E21B 43/119* (2006.01)

(52) U.S. Cl.
CPC ..... *E21B 43/1185* (2013.01); *E21B 43/119* (2013.01)

(58) Field of Classification Search
CPC .... E21B 43/1185; E21B 43/11; E21B 43/116; E21B 43/119; F42C 1/04; F42C 1/045; F42C 1/05; F42C 1/055; F42C 15/00; F42C 15/18; F42C 15/188; F42D 5/00
See application file for complete search history.

(56) References Cited

U.S. PATENT DOCUMENTS

| | | | | |
|---|---|---|---|---|
| 2,759,417 | A | 8/1956 | O'Neill, Jr. | |
| 2,833,213 | A | 5/1958 | Udry | |
| 4,172,421 | A * | 10/1979 | Regalbuto | E21B 43/1185 102/260 |
| 4,208,966 | A | 6/1980 | Hart | |
| 4,441,427 | A | 4/1984 | Barrett | |
| 4,869,170 | A | 9/1989 | Dahmberg et al. | |
| 5,027,708 | A * | 7/1991 | Gonzalez | E21B 43/1185 102/202.1 |
| 5,088,413 | A | 2/1992 | Huber et al. | |
| 5,347,929 | A | 9/1994 | Lerche et al. | |
| 5,435,250 | A | 7/1995 | Pollock | |
| 6,658,981 | B2 | 12/2003 | Rochen et al. | |
| 6,837,310 | B2 | 1/2005 | Martin | |
| 7,762,331 | B2 | 7/2010 | Goodman et al. | |
| 8,091,477 | B2 | 1/2012 | Brooks et al. | |
| 8,256,337 | B2 | 9/2012 | Hill et al. | |
| 8,661,978 | B2 | 3/2014 | Backhus et al. | |
| 8,746,144 | B2 | 6/2014 | Givens et al. | |

(Continued)

FOREIGN PATENT DOCUMENTS

EP 0874130 B1 1/2006

OTHER PUBLICATIONS

"Multi-material injection molding," retrieved from https://en.wikipedia.org/w/index.php?title=Multi-material_injection_molding&oldid=994490766, last edited Dec. 16, 2020, 3 pages.

(Continued)

*Primary Examiner* — George S Gray
(74) *Attorney, Agent, or Firm* — Trop, Pruner & Hu, P.C.

(57) ABSTRACT

A perforation gun that includes a safety mechanism to prevent detonation of the gun system.

20 Claims, 11 Drawing Sheets

(56) References Cited

U.S. PATENT DOCUMENTS

| | | | | |
|---|---|---|---|---|
| 8,770,301 | B2 | 7/2014 | Bell | |
| 8,875,787 | B2 | 11/2014 | Tassaroli | |
| 8,881,816 | B2 | 11/2014 | Glenn et al. | |
| 9,145,764 | B2 | 9/2015 | Burton et al. | |
| 9,605,937 | B2 | 3/2017 | Eitschberger et al. | |
| 9,689,223 | B2 | 6/2017 | Schacherer et al. | |
| 10,077,641 | B2 | 9/2018 | Rogman et al. | |
| 11,091,987 | B1 | 8/2021 | Benker et al. | |
| 11,655,693 | B2 | 5/2023 | Benker et al. | |
| 2012/0247771 | A1* | 10/2012 | Black | E21B 43/1185 166/55 |
| 2016/0356132 | A1 | 12/2016 | Burmeister et al. | |
| 2017/0275976 | A1 | 9/2017 | Collins et al. | |
| 2018/0299239 | A1 | 10/2018 | Eitschberger et al. | |
| 2019/0257181 | A1 | 8/2019 | Langford et al. | |
| 2020/0256166 | A1 | 8/2020 | Knight et al. | |
| 2020/0300593 | A1 | 9/2020 | Sullivan et al. | |
| 2020/0308939 | A1 | 10/2020 | Sullivan et al. | |
| 2021/0055092 | A1 | 2/2021 | Sullivan et al. | |
| 2021/0156231 | A1 | 5/2021 | Sullivan et al. | |
| 2022/0145732 | A1* | 5/2022 | Anthony | E21B 43/119 |
| 2024/0175338 | A1* | 5/2024 | Dyess | E21B 43/116 |

OTHER PUBLICATIONS

"Tandem Sub", retrieved from https://www.yjoiltools.com/Wireline-Subs/Tandem-Sub, 3 pages.

Zhao et al., "Sliding sleeve packer multistage completion in Re-exploration Programs for Petroleum-Rich Sags in Rift Basins, Advances in Key Engineering Technologies for Re-exploration 2018," https://www.sciencedirect.com/topics/engineering/completion-process.

Snyder, "Is the Shale Revolution Here to Stay," OilPrice.com - blog; https://community.oilprice.com/topic/6261-is-the-shale-revolution-here-to-stay/, May 15, 2019, 63 pages.

* cited by examiner

SAFE PERFORATION GUN SYSTEM

CROSS-REFERENCE TO RELATED APPLICATION

This application claims priority to U.S. Provisional Patent Application No. 63/438,285 filed on Jan. 11, 2023 and entitled "SAFE PERFORATION GUN SYSTEM", the content of which is hereby incorporated by reference.

TECHNICAL FIELD

Embodiments of the invention are in the field of oilfield equipment and, in particular, perforation guns.

BACKGROUND

In conventional methods a user may couple perforation guns together and then use explosives within the guns to fracture rock formations. Oil may then flow through the fractured rock formations. This may involve hydraulic "fracking", which involves injecting liquid at high pressure into subterranean rocks, boreholes, and the like to force open existing fissures and extract oil or gas. A typical perforation gun may include a long tube that includes charges. These guns may couple together with a coupler, which is sometimes called a "tandem sub" (https://***.yjoiltools.com/Wireline-Subs/Tandem-Sub). The coupler's external threads mate with internal threads of the gun.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

FIG. 1 further includes a front view of the same.

FIG. 9B shows a safe configuration and FIG. 9C shows an armed configuration.

FIG. 10A shows an insertion configuration when the first and second portions of the first connector are first coupled to one another but before they are placed in a safe or armed configuration.

DETAILED DESCRIPTION

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photograph, may appear different while still incorporating the claimed structures of the illustrated embodiments. Moreover, the drawings may only show the structures useful to understand the illustrated embodiments. Additional structures known in the art may not have been included to maintain the clarity of the drawings. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A and B" include situations with A, B, or A and B.

Applicant determined conventional systems rely to a large extent on assembly in the field. This results in expensive technicians having to assemble equipment in the field, sometimes in poor atmospheric conditions, and with non-uniform results. However, described herein are embodiments that address these concerns. Advantages of certain embodiments are, without limitation: (1) easier for field users to assemble since there the field users receive gun components largely in their final assembled form, (2) assembly of guns in a controlled manufacturing area (before the guns are transported to the field) allows for gun assembly in controlled atmospheric conditions and using consistent, uniform procedures by personnel with appropriate skill sets for assembling the guns. Other advantages are listed further below.

First Example Set

Figure 1:
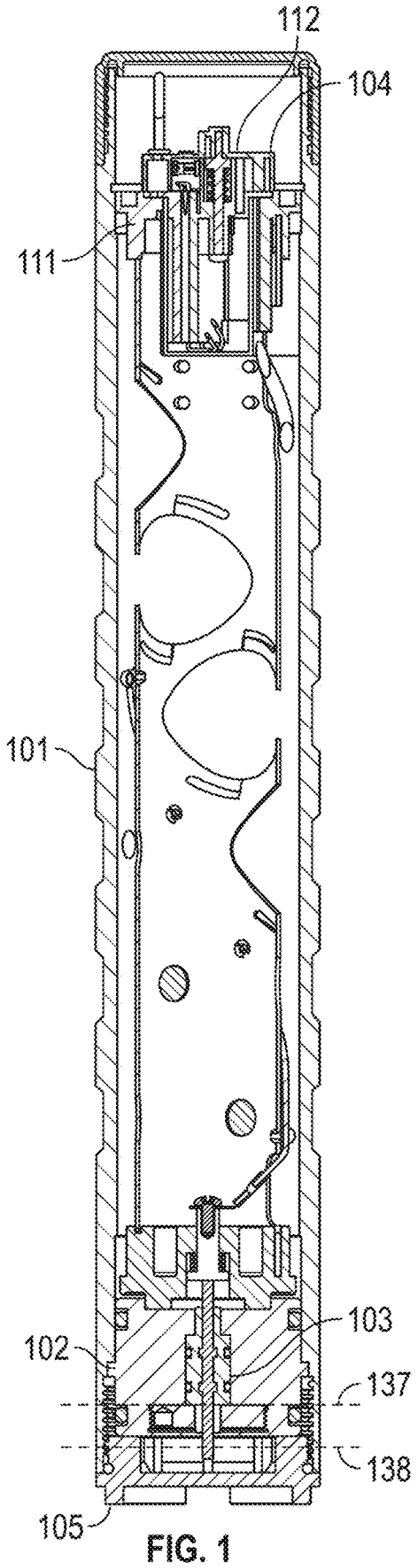
FIG. 1 includes a cross-sectional view of an embodiment of a single gun having inner and outer conduits, proximal and distal connectors (e.g., caps), and a coupler.
Figure 2:
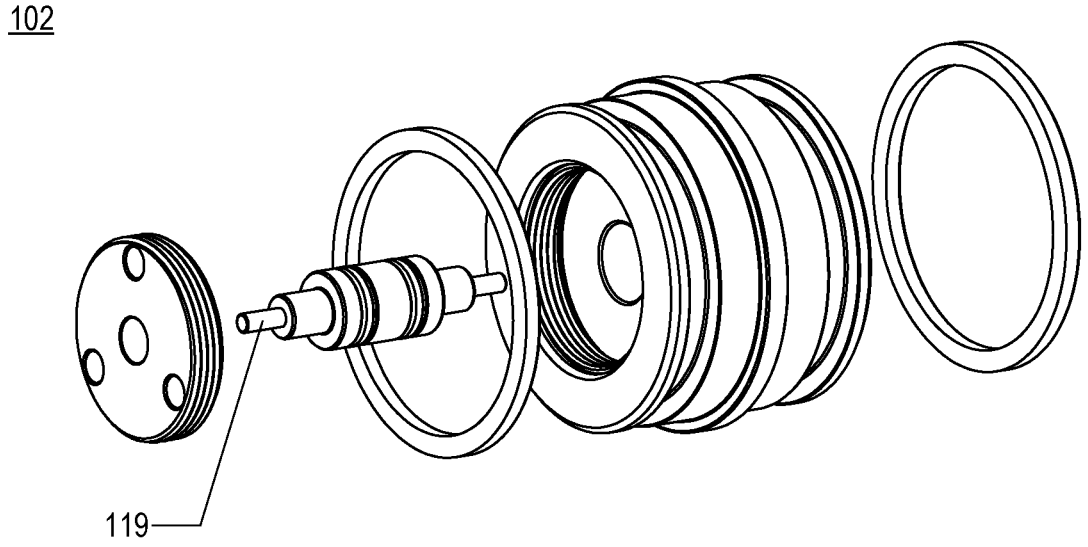
FIG. 2 includes a perspective view of an embodiment of a coupler (also known as a sub assembly) having a bulkhead.
Figure 3D:
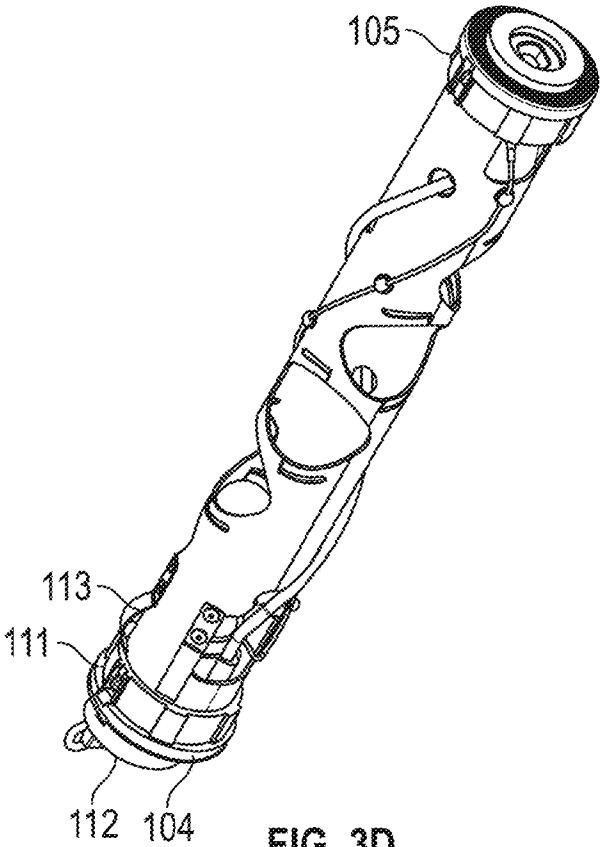
FIG. 3A includes a side view of an embodiment of an inner conduit with proximal and distal connectors. Further included are cross-sectional views (FIG. 3B and FIG. 3C) and a perspective view (FIG. 3D) of the same.
Figure 3B:
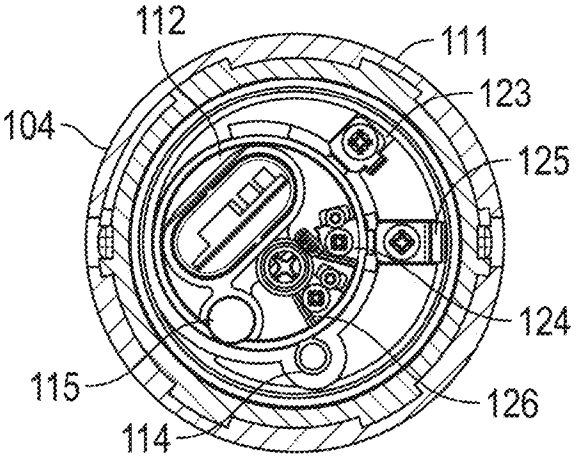
Figure 3C:
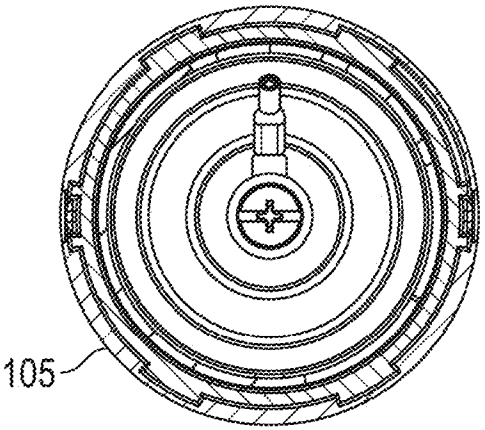
Figure 3A:
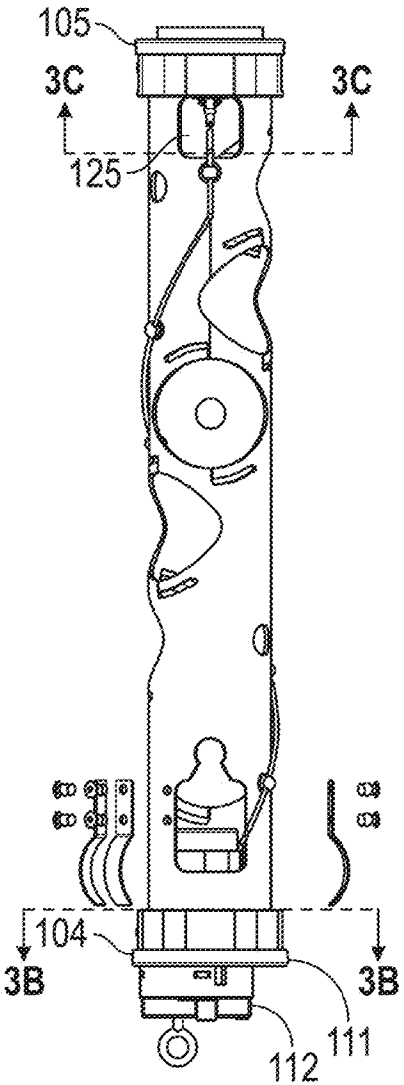
Figure 4A:
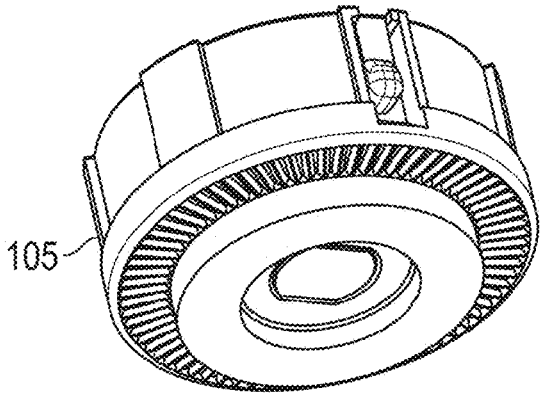
FIG. 4A includes a perspective view of an assembled proximal or "top" connector.
Figure 4B:
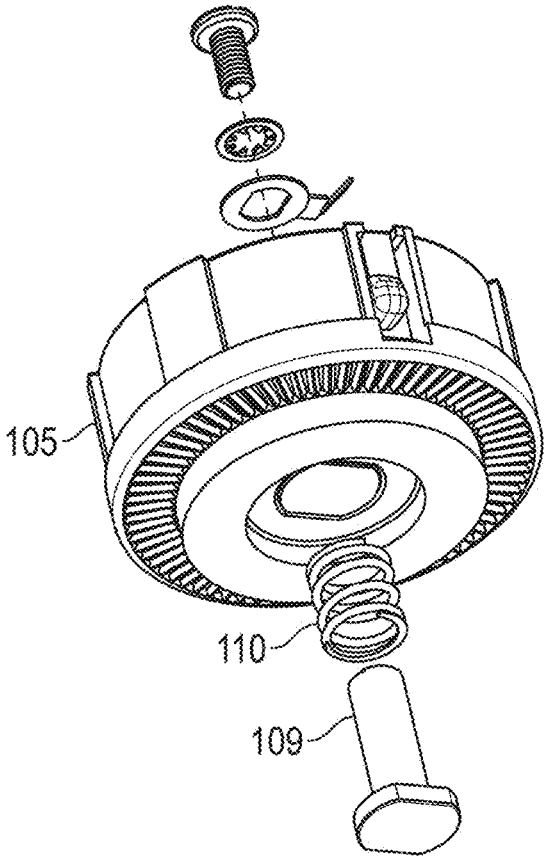
FIG. 4B includes a perspective view of a dis-assembled proximal or "top" connector.
Figure 5A:
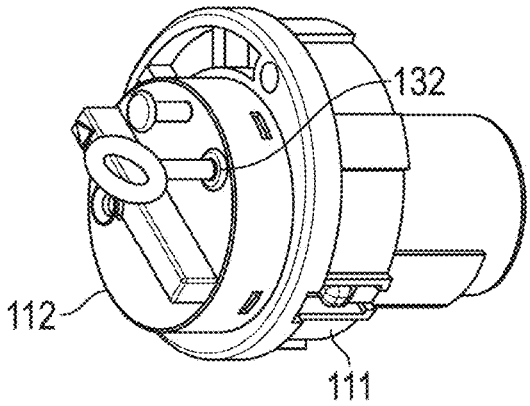
FIG. 5A includes a perspective view of an assembled distal or "bottom" or "base" connector having two portions that are coupled together.
Figure 5B:
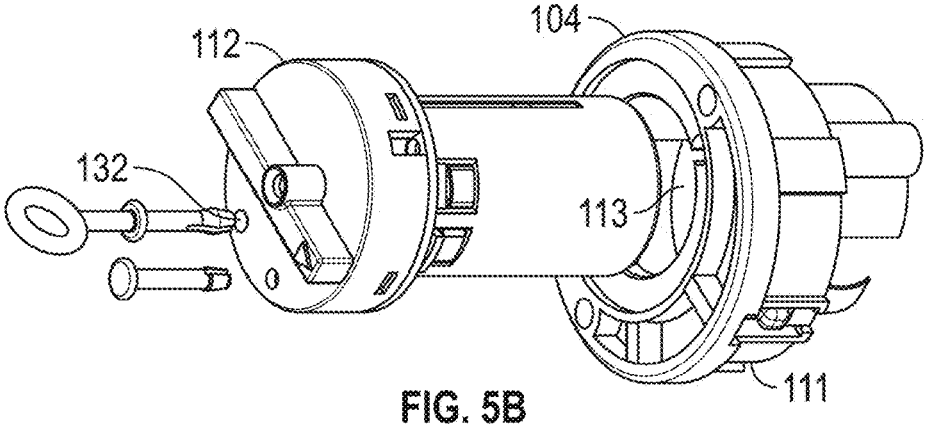
FIG. 5B includes a perspective view of a dis-assembled distal or "bottom" or "base" connector having two portions that are not coupled together.
Figure 6C:
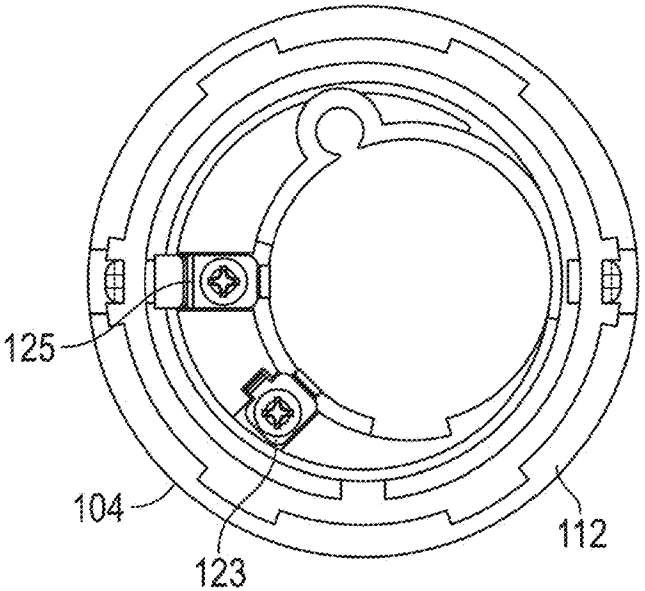
FIG. 6A and FIG. 6B include side views a distal or "bottom" connector and FIG. 6C provides a top view of a base of the distal or "bottom" connector.
Figure 6B:
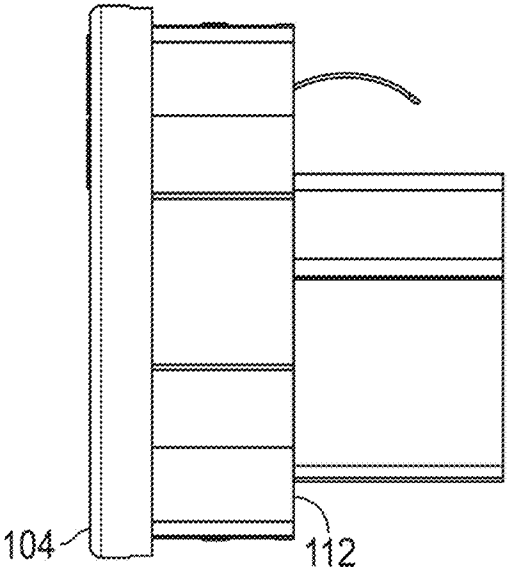
Figure 6A:
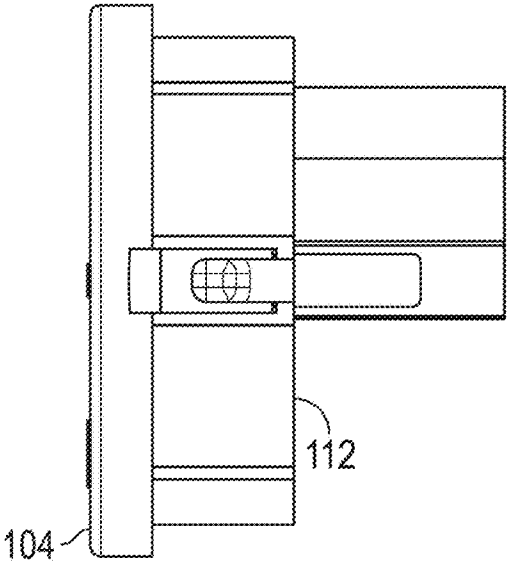
Figure 7A:
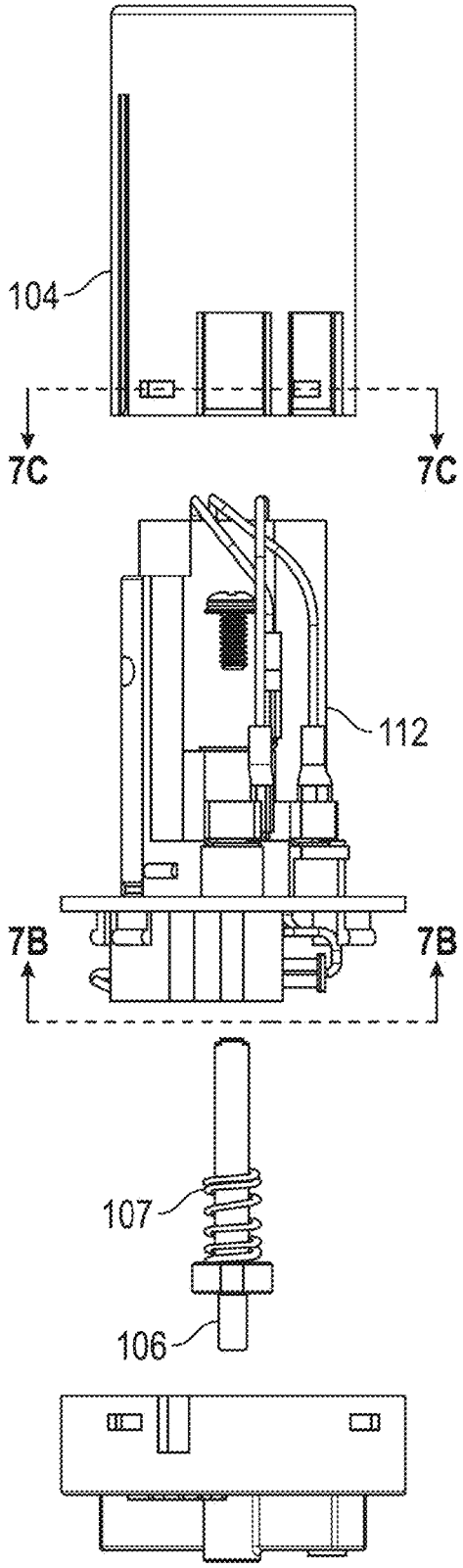
FIG. 7A includes an assembly view of a distal or "bottom" connector, including a first and second portions of the connector.
Figure 7B:
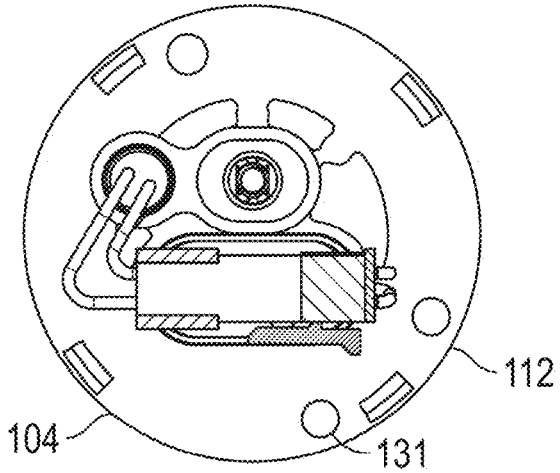
FIG. 7B provides a top view and FIG. 7C provides a cross-sectional view of the same.
Figure 7C:
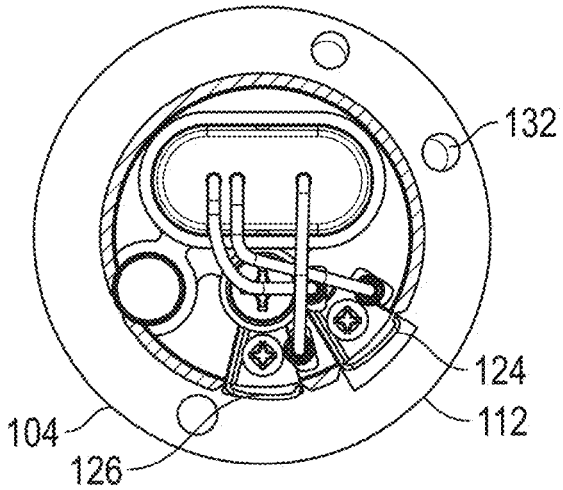
Figure 8A:
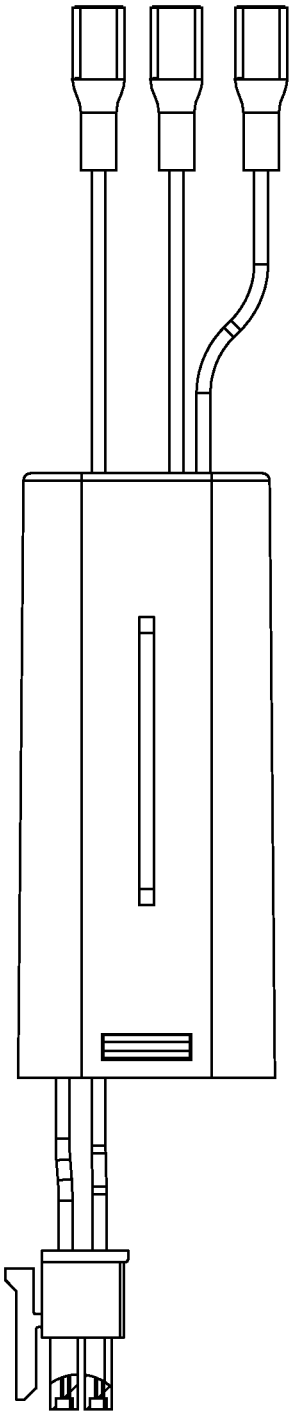
FIG. 8A includes a side view of a detonator switch and FIG. 8B provides a side view of another wire/cable.
Figure 8B:
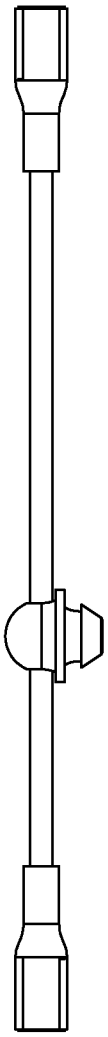
Figure 9A:
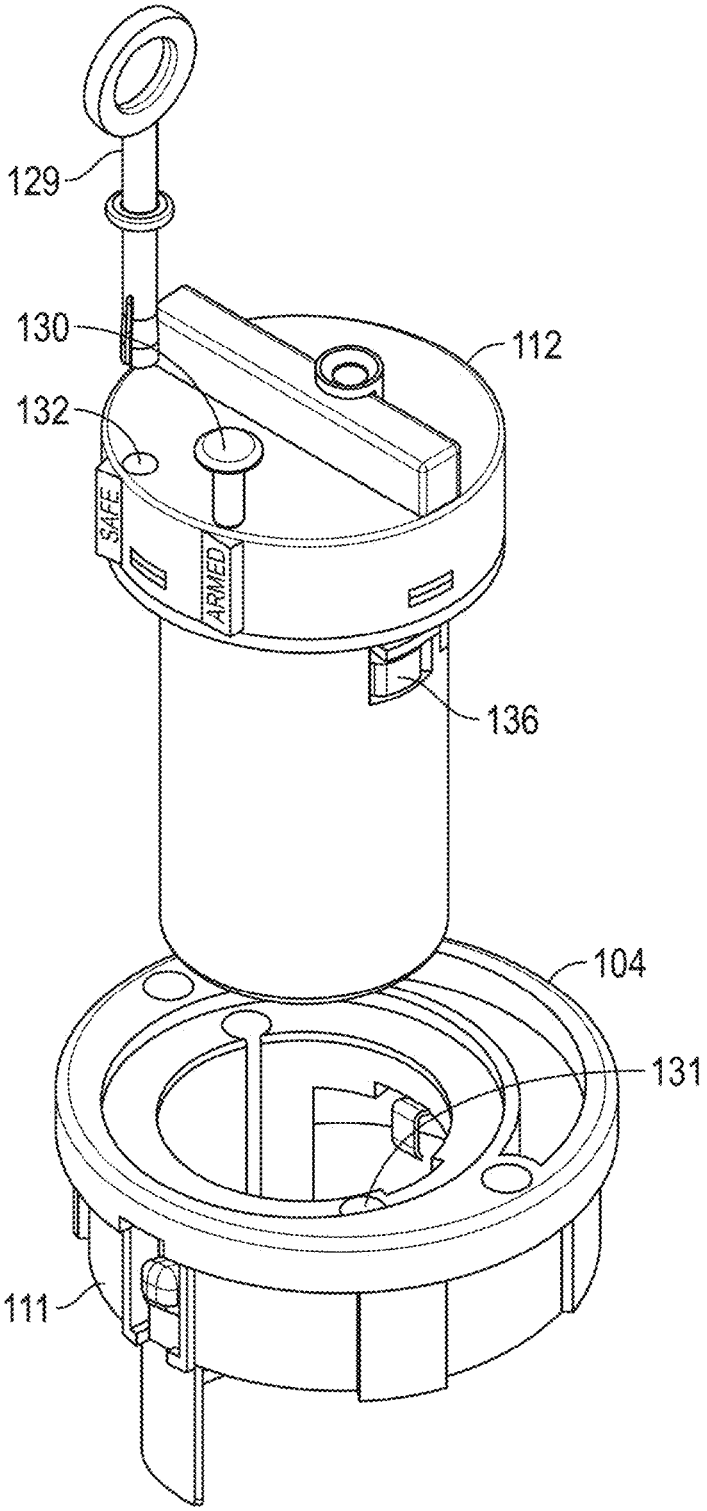
FIG. 9A shows a perspective view of first and second portions of the first connector in a disassembled configuration.
Figure 9B:
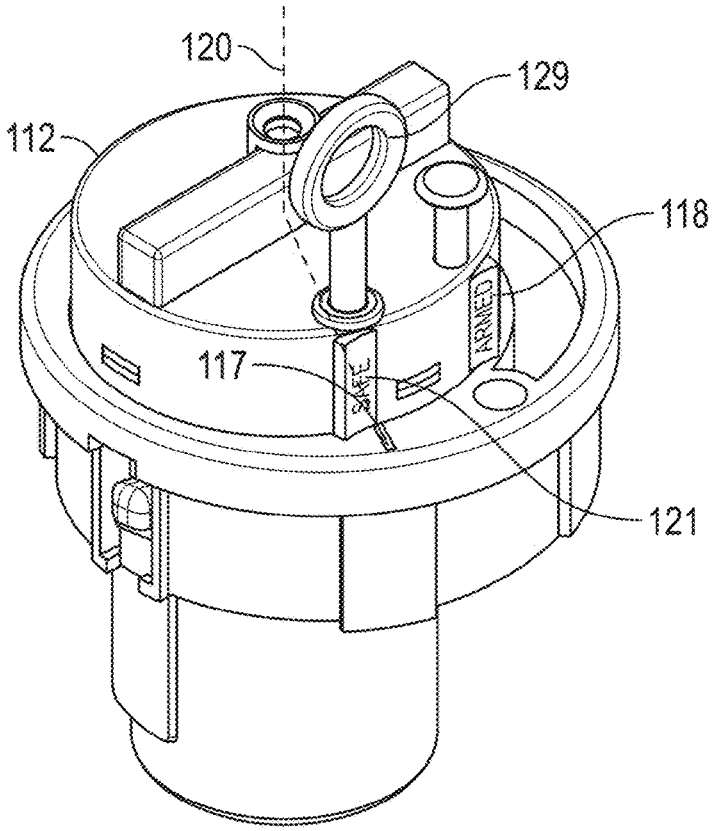
FIG. 9B and FIG. 9C show the first and second portions in an assembled state.
Figure 9C:
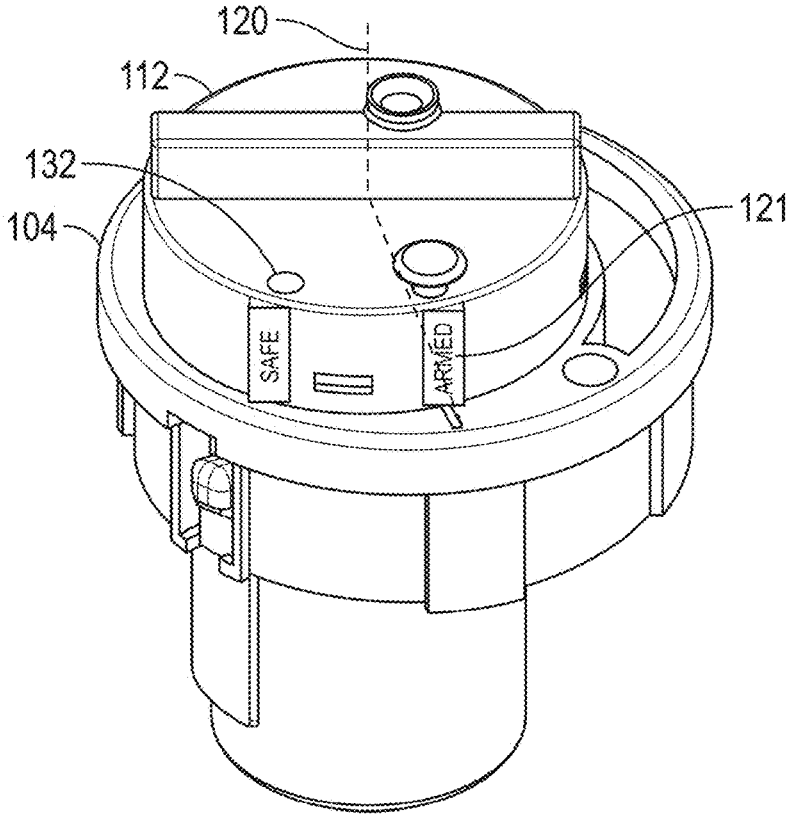

Example 1 includes a hydraulic perforating gun system comprising: a conduit (101), a coupler (102), a bulkhead (103), and first (104) and second (105) connectors. In a fully assembled configuration: (a) the first and second connectors are included within the conduit, the coupler is at least partially included within the conduit, and the bulkhead is included within the coupler, (b) the first connector is adjacent a first end of the conduit and the second connector adjacent a second end of the conduit, and (c) the second end of the conduit is opposite the first end of the conduit. The first connector includes a first electric contact (106) resiliently coupled to a body of the first connector via a first resilient member (107), and the second connector includes a second electric contact (109) resiliently coupled to a body of the second connector via a second resilient member (110). The first connector includes first (111) and second (112) portions, the second portion being separable from the first portion. The first portion includes a first orifice (113). In the fully assembled configuration the second portion is included in the first orifice, and in a dissembled configuration the second portion is separated from the first portion and the second portion is not included in the first orifice. In the fully assembled configuration: (a) the first portion includes a portion of a detonation cord (114), (b) the second portion includes a detonator (115) and an electric switch (116) configured to trigger the detonator, and (c) the first portion includes a first point (117) on its outermost perimeter and the second portion includes a second point (118) on its outermost perimeter. The fully assembled configuration includes a safe configuration (FIGS. 9B and 10B) and an armed configuration (FIGS. 9C and 10C). In the safe configuration the second point is not aligned with the first point and the detonator is not aligned with the detonation cord. In the armed configuration the second point is aligned with the first point and the detonator is aligned with the detonation cord. The coupler is unthreaded. The bulkhead includes a bulkhead electric contact (119) and the bulkhead electric contact includes no resilient members, welds, or seems. In the fully assembled configuration the bulkhead electric contact is configured to directly contact both the first electrical contact and an additional second electrical contact of an additional perforating gun.

In an embodiment the endplate base orifice if off-center within the base to provide real estate for other materials (e.g., wires, connections).

Example 2. The system of example 1, wherein the first portion includes a central axis (120). A first line segment (121) extends from the central axis orthogonal to the central axis. In the safe configuration the first line segment intersects the first point but not the second point and in the armed configuration the first line segment intersects the first and second points.

As used herein, a "central axis" does not necessarily mean an axis at a center of a circle. Instead, the axis may be located anywhere in the central region of, for example, the first portion.

Another version of example 2. The system of example 1, wherein the first portion includes a central axis. A first plane extends from the central axis and parallel to the central axis. In the safe configuration the first plane intersects the first point but not the second point and in the armed configuration the first plane intersects the first and second points.

For example, see "Note Labeled Position Indicator", "Armed", and "Safe" as area at or near first and second points on outermost perimeters of the first and second portions. In FIG. 9B the "Note Labeled Position Indicator" and "Safe" points are aligned. In FIG. 9C the "Note Labeled Position Indicator" and "Armed" points are aligned.

Example 3. The system of example 2 wherein a second line segment (122) extends from the central axis and orthogonal to the central axis. In the safe configuration the second line segment intersects the detonator but not the detonation cord and in the armed configuration the second line segment intersects the detonator and the detonation cord.

Example 4. The system according to any of examples 2 to 3, wherein in the fully assembled configuration the second portion is configured to rotate within a plane that is orthogonal to the central axis and between the safe and armed configurations.

For example, in FIG. 10C the axis goes "into the page" and the plane is co-planar or parallel to the page.

Example 5. The system according to any of examples 2 to 4, wherein: the first portion includes a first electrical contact (123, 125) and the second portion includes a second electrical contact (124, 126). A third line segment (127, 128) extends orthogonal to the central axis. In the safe configuration the third line segment does not intersect both of the first and second electrical contacts and in the armed configuration the third line segment intersects both of the first and second electrical contacts.

Example 5.1 The system according to any of examples 2 to 4, wherein: the first portion includes a first electrical contact and the second portion includes a second electrical contact. The central axis lies within a second plane. In the safe configuration the second plane does not intersect both of the first and second electrical contacts and in the armed configuration the second plane intersects both of the first and second electrical contacts.

Figure 10A:
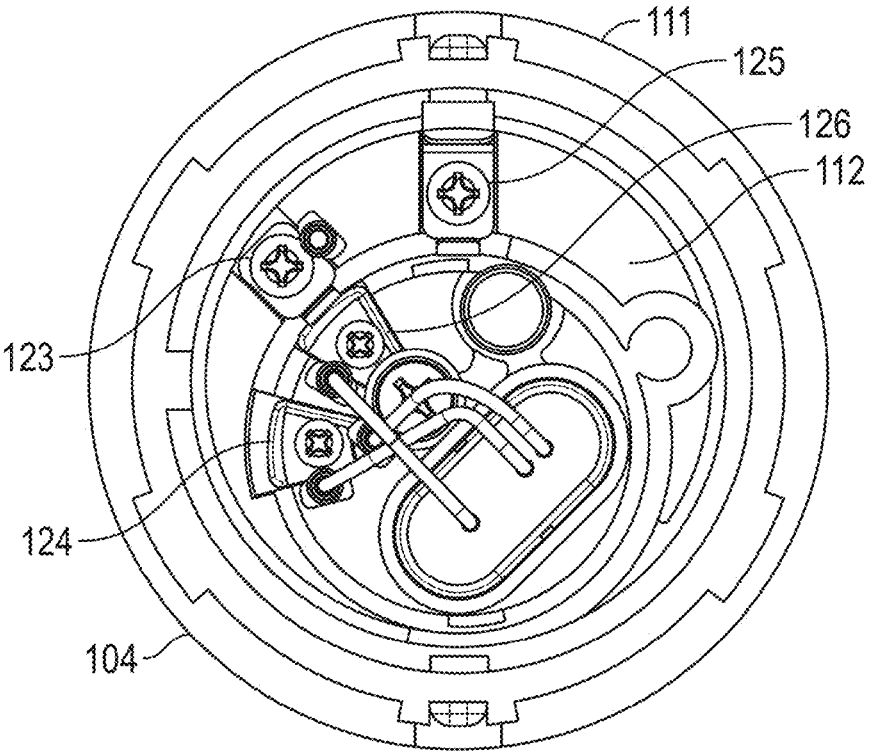
FIG. 10A shows the first and second portions in an assembled state with a cover removed such that electrical contacts are visible.
Figure 10B:
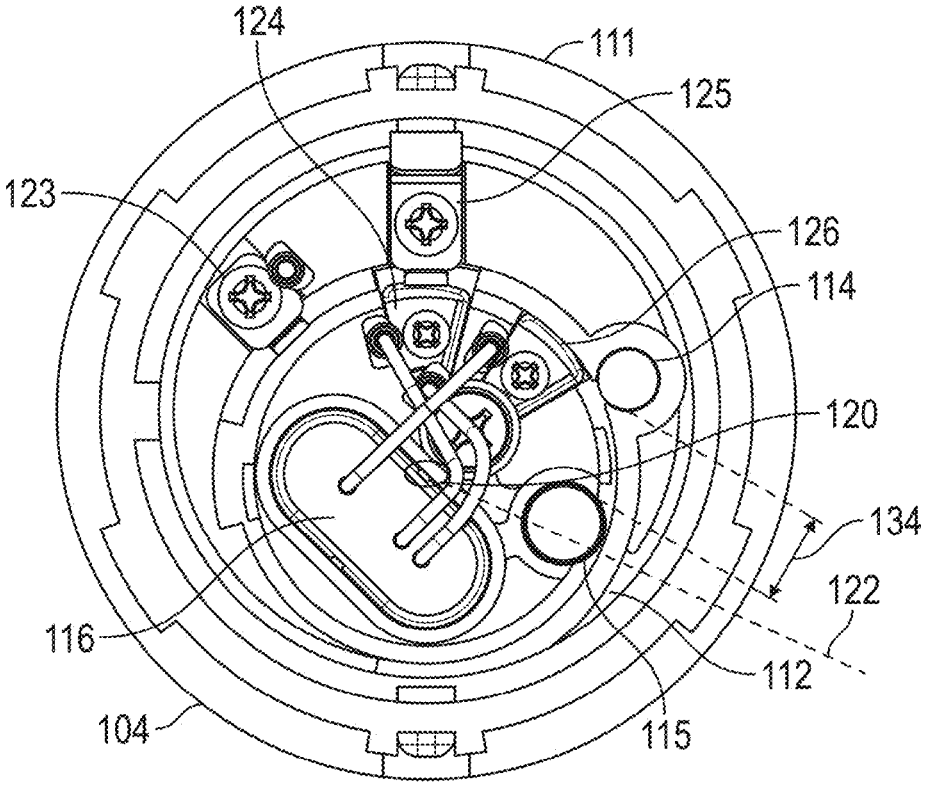
FIG. 10B shows a safe configuration and FIG. 10C shows an armed configuration.
Figure 10C:
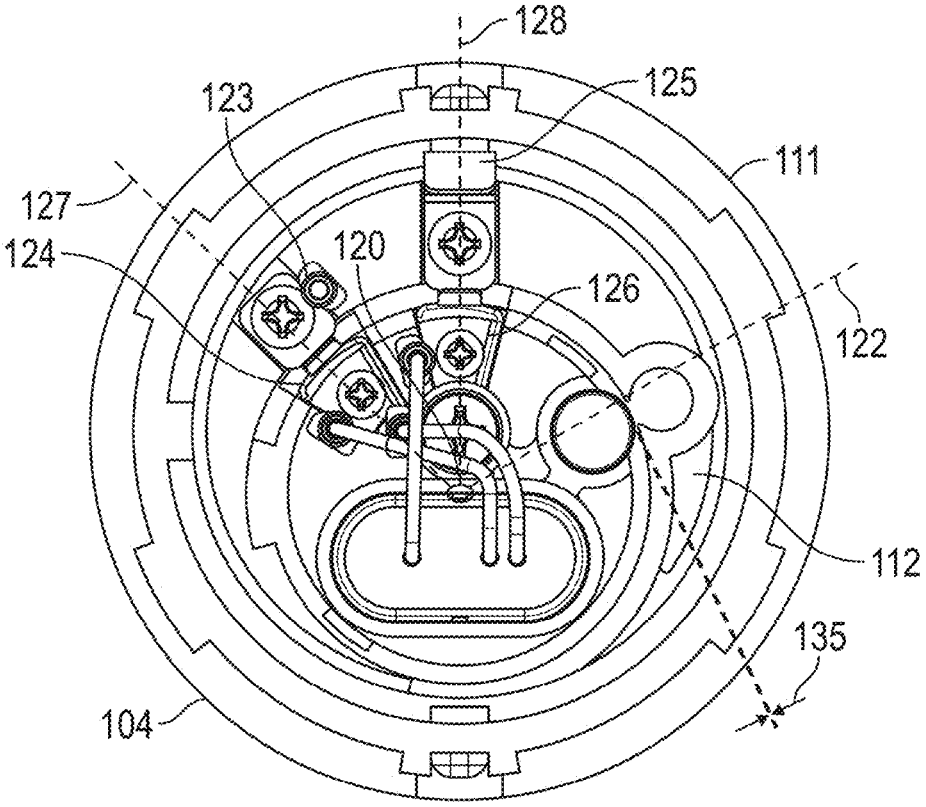

For example, FIGS. 10A, 10B, 10C show how two contacts on the second portion can be rotated into three different positions.

Example 6. The system according to examples 5 to 5.1, wherein in the safe configuration at least one of the first or second electrical contacts is coupled to a ground node.

Example 7. The system according to any of examples 1 to 6 comprising a first pin (129). In the safe configuration the first pin is included in a first pin orifice (131) of the first portion and a first pin orifice (132) of the second portion and is configured to resist transition from the safe configuration to the armed configuration. In the armed configuration the first pin is not included in the first pin orifice of the first portion.

Example 8. The system of example 7 comprising a second pin (130). In the safe configuration the second pin is not included in a second pin orifice of the first portion and is included in a second pin orifice of the second portion (133). In the armed configuration the second pin is included in the second pin orifice of the first portion and is configured to resist transition from the armed configuration.

Example 8.1 The system of example 7 comprising a second pin (130). In the safe configuration the second pin is not included in the first pin orifice (131) of the first portion and is included in a second pin orifice of the second portion (133). In the armed configuration the second pin is included in the first pin orifice of the first portion and is configured to resist transition from the armed configuration.

Example 9. The system according to any of examples 7 to 8 comprising a resilient member that biases the second pin toward the second pin orifice of the first portion.

Example 10. The system according to any of examples 1 to 9, wherein in the safe configuration the detonator is no closer than 0.20 inches (134) to the detonation cord. In the armed configuration the detonator is no further than 0.10 inches (135) from the detonation cord.

As a result, an embodiment may provide the ability to ship the system on public roads in a safe manner. For example, the gun system may be loaded onto a truck or trailer while the system is loaded with charges, detonation cord coupled to the charges, the detonator, the detonator switch, and the first and second connectors and coupler are all included in the conduit. The system may be transported on a public roadway in such an assembled state. Once the system arrives at a job site, technicians may couple multiple guns to each other. The effort is made quicker and more uniform than previous efforts because the technician simply needs to withdraw the first pin, rotate the second portion from the safe configuration to the armed configuration, and then lock the system into the armed configuration via the second pin.

In other embodiments, range 134 is at least 0.20, 0.40, 0.50 inches or more. In other embodiments, range 135 is no more than 0.02, 0.04, 0.06, or 0.08 inches.

Example 11. The system according to any of examples 1 to 10, wherein the first portion includes a detent and the detent is configured to partially, but not entirely, resist transition from the armed configuration to an additional configuration that is neither the armed configuration nor the safe configuration.

The "additional configuration" may be a beginning position (FIG. 10A) when the second portion is initially inserted into the first portion and before the second portion is rotated into or otherwise moved into the safe or armed configurations.

The detent may include, for example a channel present in the first portion wherein the channel has different widths such that a male member (136) from the second portion, which inserts into the channel, may experience increased resistance as it rotates into a more constricted area of the channel. Such an area may exist as the second portion rotates from the safe configuration to the armed configuration. The detent may be such that additional force may be used to force the male member through the more constricted area of the channel and into a more relaxed portion of the channel where the male member may proceed to the "additional configuration" location. For example, they may be needed or desired if the gun system is disassembled for whatever reason.

Other forms of detents are known such as, for example, a ball bearing that is biased (from a resilient member) into a channel. A male member in the channel could bypass the ball bearing or bead by forcing the ball bearing or bead such that the resilient member is compressed and the male member may pass along the channel.

Example 12. The system according to any of examples 1-11 wherein in the fully assembled configuration the first resilient member biases the first electrical contact towards the bulkhead in a first direction and the second resilient member biases the second electrical contact in a second direction that is opposite the first direction.

Example 13. The system according to any of examples 1-12, wherein in the fully assembled configuration: (a) the conduit includes a long axis that intersects the second and first connectors; (b) a first plane (137), which is orthogonal to the long axis, intersects the bulkhead and the bulkhead electric contact; and (c) a second plane (138), which is orthogonal to the long axis, intersects the bulkhead electric contact but not the bulkhead.

Example 14. The system according to any of examples 1-13, wherein in the fully assembled configuration: (a) the bulkhead includes a gasket; (b) the gasket (see O-ring in Sheet 2 of 7) directly contacts the bulkhead electric contact; (c) the conduit includes a long axis that intersects the second and first connectors; and (d) a plane, which is orthogonal to the long axis, intersects the bulkhead electric contact and the gasket.

Example 15. The system according to any of examples 1-14, wherein in the fully assembled configuration: (a) the conduit includes a first long axis that intersects the second and first connectors; and (b) the bulkhead electric contact includes a second long axis that is collinear with the first long axis.

Example 16. The system of example 15, wherein in the fully assembled configuration: (a) the bulkhead electric contact includes first and second portions; (b) the first portion includes a first width that is oriented orthogonal to the second long axis; (c) the second portion include a second width that is oriented orthogonal to the second long axis; (d) the first width is unequal to the second width; (e) a first plane, which is orthogonal to the second long axis, intersects the bulkhead and the first portion; and a second plane, which is orthogonal to the second long axis, intersects the bulkhead and the second portion.

Example 17. The system of example 16, comprising a mold, wherein the mold includes a non-metal material. The bulkhead electric contact includes metal. The bulkhead includes the mold. The mold directly contacts and is form-fitted to the first and second portions of the bulkhead electric contact.

Example 18. The system according to any of examples 1-17, wherein: the conduit includes internal threads, the coupler includes a projection, and the internal threads are keyed to the coupler's projection.

Example 19. The system of example 18, wherein the coupler is keyed to the first connector.

Example 20. The system according to any of examples 1-19, wherein in the fully assembled configuration: (a) the conduit includes a long axis that intersects the second and first connectors; (b) a first plane, which is orthogonal to the long axis, intersects the first electric contact; (c) the first electric contact includes a non-circular cross-section within the first plane; (d) a second plane, which is orthogonal to the long axis, intersects the second electric contact; (e) the second electric contact includes a non-circular cross-section within the second plane.

Example 21. The system according to any of examples 1-20, wherein in the fully assembled configuration: (a) the first connector has a second face and a first face, and the second face is between the first face and the second connector; (b) the first face of the first connector includes a first projection and a first recess; (c) a second face of the coupler includes a second recess and a second projection; (d) the first projection is keyed to the second recess and the second projection is keyed to the first recess; (e) the conduit includes a long axis that intersects the second and first connectors; (f) a plane, which is orthogonal to the long axis, intersects the first projection but not the first recess.

Example 22. The system of example 21, wherein neither of the first projection or the first recess includes metal.

Example 23. The system of example 21, wherein in the fully assembled configuration the second projection couples to a resilient member that biases the projection away from the second face of the coupler and towards the first connector.

Example 24. The system according to any of examples 1-23, wherein the coupler is configured to couple the perforating gun to the additional perforating gun and to reduce a transmission of explosive induced pressure between the perforating gun and the additional perforating gun.

The above examples pertain to a system, such as a system that may be transported on a public roadway in a safe manner. However, various configurations are possible. For example, the first connector may be shipped separately from other components of the system. The following examples correspond to such a scenario.

Second Example Set

Example 1a includes a hydraulic perforating gun component comprising a first connector configured to be included within a conduit along with a coupler, a bulkhead, and a second connector. In a fully assembled configuration the first connector is included within the conduit and adjacent a first end of the conduit, and the first connector includes a first electric contact resiliently coupled to a body of the first connector via a first resilient member. The first connector includes first and second portions. The second portion is separable from the first portion. The first portion includes a first orifice. In the fully assembled configuration the second portion is included in the first orifice, and in a dissembled configuration the second portion is separated from the first portion and the second portion is not included in the first orifice. In the fully assembled configuration: (a) the first portion includes a portion of a detonation cord, (b) the second portion includes a detonator and an electric switch configured to trigger the detonator, (c) the first portion includes a first point on its outermost perimeter and the second portion includes a second point on its outermost perimeter. The fully assembled configuration includes a safe configuration and an armed configuration. In the safe configuration the second point is not aligned with the first point and the detonator is not aligned with the detonation cord. In the armed configuration the second point is aligned with the first point and the detonator is aligned with the detonation cord.

Thus, the connector may be packaged, sold, shipped separately from other gun components such as the conduit.

Example 2a. The system of example 1a, wherein the first portion includes a central axis. A first line segment extends from the central axis and orthogonal to the central axis. In the safe configuration the first line segment intersects the first point but not the second point. In the armed configuration the first line segment intersects the first and second points.

Example 3a. The system of example 2a, wherein a second line segment extends from the central axis and orthogonal to the central axis. In the safe configuration the second line segment intersects the detonator but not the detonation cord. In the armed configuration the second line segment intersects the detonator and the detonation cord.

Example 4a. The system according to any of examples 2a to 3a, wherein in the fully assembled configuration the second portion is configured to rotate within a plane that is orthogonal to the central axis and between the safe and armed configurations.

Example 5a. The system according to any of examples 2a to 4a, wherein: the first portion includes a first electrical contact and the second portion includes a second electrical contact. A third line segment extends parallel to the central axis. In the safe configuration the third line segment does not intersect both of the first and second electrical contacts. In the armed configuration the third line segment intersects both of the first and second electrical contacts.

Example 6a. The system according to example 5a, wherein in the safe configuration at least one of the first and second electrical contacts is coupled to a ground node.

Example 7a. The system according to any of examples 1a to 6a comprising a first pin. In the safe configuration the first pin is included in a first pin orifice of the first portion and a first pin orifice of the second portion and is configured to resist transition from the safe configuration to the armed configuration. In the armed configuration the first pin is not included in the first pin orifice of the first portion.

However, with certain embodiments the first connector may be shipped separately from a conduit that includes charges. In such a case, the use of a first pin (or any other pin) to ensure a safety mode is maintained may be unnecessary.

Example 8a. The system of example 7a comprising a second pin. In the safe configuration the second pin is not included in a second pin orifice of the first portion and is included in a second pin orifice of the second portion. In the armed configuration the second pin is included in the second pin orifice of the first portion and is configured to resist transition from the armed configuration.

Example 9a. The system according to any of examples 7a to 8a comprising a resilient member that biases the second pin toward the second pin orifice of the first portion.

Example 10a. The system according to any of examples 1a to 9a, wherein: in the safe configuration the detonator is no closer than 0.20 inches to the detonation cord; in the armed configuration the detonator is no further than 0.10 inches from the detonation cord.

Example 11a. The system according to any of examples 1a to 10a, wherein: the first portion includes a detent. The detent is configured to partially, but not entirely, resist transition from the armed configuration to an additional configuration that is neither the armed configuration nor the safe configuration.

Example Set 3

Example 1b. A hydraulic perforating gun component comprising: a first connector; wherein: (a) in a fully assembled configuration the first connector is adjacent a first end of the gun, and (b) the first connector includes a first electric contact resiliently coupled to a body of the first connector via a first resilient member; wherein: (a) the first connector includes first and second portions, the second portion being separable from the first portion, (b) the first portion includes a first orifice; (c) in the fully assembled configuration the second portion is included in the first orifice, (d) in a dissembled configuration and second portion is separated from the first portion and the second portion is not included in the first orifice; wherein in the fully assembled configuration: (a) the first portion includes a portion of a detonation cord, (b) the second portion includes a detonator and an electric switch configured to trigger the detonator, (c) the first portion includes a first point on its outermost perimeter and the second portion includes a second point on its outermost perimeter; wherein: (a) the fully assembled configuration includes a safe configuration and an armed configuration, (b) in the safe configuration the second point is not aligned with the first point and the detonator is not aligned with the detonation cord, (c) in the armed configuration the second point is aligned with the first point and the detonator is aligned with the detonation cord.

Thus, the connector may be packaged, sold, shipped separately from other gun components such as the conduit.

Example Set 4

Example 1c. A hydraulic perforating gun component comprising: a first connector including a first electric contact; wherein: (a) the first connector includes first and second portions, the second portion being separable from the first portion, (b) the first portion includes a first orifice; (c) in the fully assembled configuration the second portion is included in the first orifice, (d) in a dissembled configuration and second portion is separated from the first portion and the second portion is not included in the first orifice; wherein in the fully assembled configuration: (a) the first portion includes a portion of a detonation cord, (b) the second portion includes a detonator and an electric switch configured to trigger the detonator, (c) the first portion includes a first point on its outermost perimeter and the second portion includes a second point on its outermost perimeter; wherein: (a) the fully assembled configuration includes a safe configuration and an armed configuration, (b) in the safe configuration the second point is not aligned with the first point and the detonator is not aligned with the detonation cord, (c) in the armed configuration the second point is aligned with the first point and the detonator is aligned with the detonation cord.

Thus, the first connector is not limited to any one location within a gun system and may or may not include previously mentioned resilient members.

Example Set 5

Example 1d. A hydraulic perforating gun component comprising: a first housing including a first electric contact; wherein: (a) the first housing includes first and second portions, the second portion being slidingly couplable with the first portion, (b) the first portion includes a first orifice and the second portion is included, at least partially, in the first orifice; wherein in an assembled configuration: (a) the first portion includes a portion of a detonation cord, (b) the second portion includes a detonator and an electric switch configured to trigger the detonator; wherein: (a) the fully assembled configuration includes a safe configuration and an armed configuration and the second portion is slidable between the safe and armed configurations, (b) in the safe configuration the detonator is not aligned with the detonation cord, (c) in the armed configuration the detonator is aligned with the detonation cord.

Thus, not all embodiments necessarily include previously discussed alignment points and the like.

Example 2d. The system of example 1d, wherein: the first portion includes a central axis; a first line segment extends from the central axis and orthogonal to the central axis; in the safe configuration the first line segment intersects the detonator but not the detonation cord; in the armed configuration the first line segment intersects the detonator and the detonation cord.

Example 3d. The system according to any of example 2d, wherein in the fully assembled configuration the second portion is configured to rotate within a plane that is orthogonal to the central axis and between the safe and armed configurations.

Example 4d. The system according to any of examples 2d to 3d, wherein: the first portion includes a first electrical contact and the second portion includes a second electrical contact; a second line segment extends orthogonal to the central axis; in the safe configuration the second line segment does not intersect both of the first and second electrical contacts; in the armed configuration the second line segment intersects both of the first and second electrical contacts.

Example 5d. The system according to example 4d, wherein in the safe configuration at least one of the first and second electrical contacts is coupled to a ground node.

Example 6d. The system according to any of examples 1d to 5d comprising a first pin, wherein: in the safe configuration the first pin is included in a first pin orifice of the first portion and a first pin orifice of the second portion and is configured to resist transition from the safe configuration to the armed configuration; in the armed configuration the first pin is not included in the first pin orifice of the first portion.

However, with certain embodiments the first housing may be shipped separately from a conduit that includes charges. In such a case, the use of a first pin (or any other pin) to ensure a safety mode is maintained may be unnecessary.

Example 7d. The system of example 6d comprising a second pin, wherein: in the safe configuration the second pin is not included in a second pin orifice of the first portion and is included in a second pin orifice of the second portion; in the armed configuration the second pin is included in the second pin orifice of the first portion and is configured to resist transition from the armed configuration.

Example 8d. The system according to any of examples 6d to 7d comprising a resilient member that biases the second pin toward the second pin orifice of the first portion.

Example 9d. The system according to any of examples 1d to 8d, wherein: in the safe configuration the detonator is no closer than 0.20 inches to the detonation cord; in the armed configuration the detonator is no further than 0.10 inches from the detonation cord.

Example 10d. The system according to any of examples 1d to 9d, wherein: the first portion includes a detent; and the detent is configured to partially, but not entirely, resist transition from the armed configuration to an additional configuration that is neither the armed configuration nor the safe configuration.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A perforating gun system comprising:

a conduit, a coupler, a bulkhead, and first and second connectors;

first and second electric contacts;

a first pin;

wherein in a fully assembled configuration: (a) the first and second connectors are included within the conduit, the coupler is at least partially included within the conduit, and the bulkhead is included within the coupler, (b) the first connector is adjacent a first end of the conduit and the second connector is adjacent a second end of the conduit, and (c) the second end of the conduit is opposite the first end of the conduit;

wherein (a) the first connector includes the first electric contact resiliently coupled to a body of the first connector via a first resilient member, and (b) the second connector includes the second electric contact resiliently coupled to a body of the second connector via a second resilient member;

wherein: (a) the first connector includes first and second portions, the second portion being separable from the first portion, (b) the first portion includes a first orifice;, (c) in the fully assembled configuration the second portion is included in the first orifice, (d) in a dissembled configuration the second portion is separated from the first portion and the second portion is not included in the first orifice;

wherein in the fully assembled configuration: (a) the first portion is configured to include a portion of a detonation cord, (b) the second portion is configured to include a detonator and an electric switch configured to trigger the detonator, (c) the first portion includes a first location on an outermost perimeter of the first portion and the second portion includes a second location on an outermost perimeter of the second portion;

wherein (a) the fully assembled configuration includes a safe configuration and an armed configuration, (b) in the safe configuration the second location is not aligned with the first location and the detonator is not aligned with the detonation cord, (f) in the armed configuration the second location is aligned with the first location and the detonator is aligned with the detonation cord;

wherein: (a) the coupler is unthreaded, (b) the bulkhead includes a bulkhead electric contact and the bulkhead electric contact includes no resilient members, welds, or seams, and (c) in the fully assembled configuration the bulkhead electric contact is configured to directly contact both the first electric contact and a third electric contact, the third electric contact being included on an additional perforating gun;

wherein: (a) in the safe configuration the first pin is included in a first pin orifice of the first portion and a first pin orifice of the second portion and is configured to resist transition from the safe configuration to the armed configuration; (b) in the armed configuration the first pin is not included in the first pin orifice of the first portion.

2. The system of claim 1, wherein:

the first portion includes a central axis;

the central axis lies within a first plane;

in the safe configuration the first plane intersects the first location but not the second location;

in the armed configuration the first plane intersects the first and second locations.

3. The system of claim 2, wherein:

a first line segment extends from the central axis and orthogonal to the central axis;

in the safe configuration the first line segment intersects the detonator but not the detonation cord;

in the armed configuration the first line segment intersects the detonator and the detonation cord.

4. The system of claim 2, wherein in the fully assembled configuration the second portion is configured to rotate around the central axis between the safe and armed configurations.

5. The system of claim 2 comprising fourth and fifth electric contacts, wherein:

the first portion includes the fourth electric contact and the second portion includes the fifth electric contact;

the central axis lies within a second plane that is non-coplanar with the first plane;

in the safe configuration the second plane does not intersect both of the fourth and fifth electric contacts;

in the armed configuration the second plane intersects both of the fourth and fifth electric contacts.

6. The system of claim 5, wherein in the safe configuration at least one of the fourth or fifth electric contacts is coupled to a ground node.

7. The system of claim 1 comprising a second pin, wherein:

in the safe configuration the second pin is not included in a second pin orifice of the first portion and is included in a second pin orifice of the second portion;

in the armed configuration the second pin is included in the second pin orifice of the first portion and is configured to resist transition from the armed configuration.

8. The system of claim 1 comprising a second pin, wherein:

in the safe configuration the second pin is not included in the first pin orifice of the first portion and is included in a second pin orifice of the second portion;

in the armed configuration the second pin is included in the first pin orifice of the first portion and is configured to resist transition from the armed configuration.

9. The system of claim 1, wherein:

in the safe configuration the detonator is no closer than 0.20 inches to the detonation cord;

in the armed configuration the detonator is no further than 0.10 inches from the detonation cord.

10. The system of claim 1, wherein:

the first portion includes a detent; and the detent is configured to partially, but not entirely, resist transition from the armed configuration to an additional configuration that is neither the armed configuration nor the safe configuration.

11. The system of claim 1, wherein in the fully assembled configuration the first resilient member biases the first electric contact towards the bulkhead in a first direction and the second resilient member biases the second electric contact in a second direction that is opposite the first direction.

12. The system of claim 1, wherein the coupler is configured to couple the perforating gun system to the additional perforating gun and to reduce a transmission of explosive induced pressure between the perforating gun system and the additional perforating gun.

13. The system of claim 1 including the detonation cord, the detonator, the electric switch, and at least one charge.

14. A perforating gun component system comprising:

a first housing including a first electric contact;

second and third electric contacts;

wherein: (a) the first housing includes first and second portions, the second portion being slidingly couplable with the first portion, (b) the first portion includes a first orifice and a central axis and the second portion is included, at least partially, in the first orifice;

wherein in an assembled configuration: (a) the first portion is configured to include a portion of a detonation cord, (b) the second portion is configured to include a detonator and an electric switch configured to trigger the detonator;

wherein: (a) the assembled configuration includes a safe configuration and an armed configuration and the second portion is slidable between the safe and armed configurations, (b) in the safe configuration the detonator is not aligned with the detonation cord, (c) in the armed configuration the detonator is aligned with the detonation cord;

wherein: (a) the first portion includes the second electric contact and the second portion includes the third electric contact; (b) a second line segment extends orthogonal to the central axis; (c) in the safe configuration the second line segment does not intersect both of the second and third electric contacts; and (d) in the armed configuration the second line segment intersects both of the second and third electric contacts.

15. The system of claim 14, wherein:

a first line segment extends from the central axis and orthogonal to the central axis;

in the safe configuration the first line segment intersects the detonator but not the detonation cord;

in the armed configuration the first line segment intersects the detonator and the detonation cord.

16. The system according to any of claim 15, wherein in the assembled configuration the second portion is configured to rotate around the central axis between the safe and armed configurations.

17. The system of claim 14, wherein in the safe configuration at least one of the second and third electric contacts is coupled to a ground node.

18. The system of claim 14 comprising a first pin, wherein:

in the safe configuration the first pin is included in a first pin orifice of the first portion and a first pin orifice of the second portion and is configured to resist transition from the safe configuration to the armed configuration;

in the armed configuration the first pin is not included in the first pin orifice of the first portion.

19. The system of claim 14, wherein:

in the safe configuration the detonator is no closer than 0.20 inches to the detonation cord;

in the armed configuration the detonator is no further than 0.10 inches from the detonation cord.

20. The system of claim 19 comprising the detonation cord, the detonator, the electric switch, and at least one charge.

* * * * *